US008733255B2

(12) United States Patent
Moreno Rueda et al.

(10) Patent No.: US 8,733,255 B2
(45) Date of Patent: May 27, 2014

(54) CONVEYING MEANS AND METHOD FOR CONVEYING HOT MATERIAL

(75) Inventors: Rafael Moreno Rueda, Alpen (DE); Jeremy Phillip Kirsch, Gauteng (ZA)

(73) Assignee: Clyde Bergemann Drycon GmbH, Wesel (DE)

( * ) Notice: Subject to any disclaimer, the term of this patent is extended or adjusted under 35 U.S.C. 154(b) by 255 days.

(21) Appl. No.: 13/157,440

(22) Filed: Jun. 10, 2011

(65) Prior Publication Data

US 2011/0308435 A1 Dec. 22, 2011

(30) Foreign Application Priority Data

Jun. 16, 2010 (DE) ..... 10 2010 024 020

(51) Int. Cl.
*F23J 1/02* (2006.01)
*B65G 15/00* (2006.01)

(52) U.S. Cl.
USPC ..... 110/165 R; 110/344; 110/185; 110/186; 110/101 CD; 34/231; 34/226

(58) Field of Classification Search
USPC ..... 34/566, 428, 429, 430, 226, 231; 202/218; 110/334, 186, 101 CD, 165 R
See application file for complete search history.

(56) References Cited

U.S. PATENT DOCUMENTS 1,863,207 A * 6/1932 Rasmussen ..... 34/191
2,144,919 A * 1/1939 Gautreau ..... 34/461
2,212,916 A * 8/1940 Hawkins et al. ..... 62/380
2,326,115 A * 8/1943 Arthur ..... 34/226
3,012,335 A * 12/1961 Claes et al. ..... 34/638
3,403,527 A * 10/1968 Berreth et al. ..... 62/266
3,818,813 A * 6/1974 Freeman ..... 454/228
4,173,831 A * 11/1979 McCord ..... 34/236
4,229,947 A * 10/1980 Klee ..... 62/374
4,285,282 A 8/1981 Good
4,327,869 A * 5/1982 Nawa et al. ..... 239/590.5
4,357,762 A * 11/1982 Eustacchio ..... 34/229
4,380,877 A * 4/1983 Poux ..... 34/225
4,403,479 A * 9/1983 Rasovich ..... 62/63
4,750,276 A * 6/1988 Smith et al. ..... 34/612

(Continued)

FOREIGN PATENT DOCUMENTS

DE 10 2008 052 085 A1 4/2010
DE 10 2008 054 098 A1 5/2010

(Continued)

OTHER PUBLICATIONS

Definition of deflector in English. Oxford Dictionaries. Retrieved Sep. 20, 2013. Retrieved from the Internet from: <URL: http://oxforddictionaries.com/us/definition/american_english/deflector?q=deflector>.*

*Primary Examiner* — Kenneth Rinehart
*Assistant Examiner* — Sharla Magana
(74) *Attorney, Agent, or Firm* — BainwoodHuang

(57) ABSTRACT

A conveying means for hot material, including at least one conveyor belt and at least one housing at least partially surrounding the at least one conveyor belt, wherein at least one deflecting means for deflecting a gas flow flowing longitudinally with respect to the at least one conveyor belt towards the at least one conveyor belt is arranged in or on the housing, and wherein the gas flow can be deflected by the at least one deflecting means over at least 25% of a length of the at least one conveyor belt.

9 Claims, 2 Drawing Sheets

(56) References Cited

U.S. PATENT DOCUMENTS

| | | | | | |
|---|---|---|---|---|---|
| 4,750,277 | A * | 6/1988 | Kuhl | 34/217 |
| 4,757,800 | A * | 7/1988 | Shei et al. | 126/21 A |
| 4,852,358 | A * | 8/1989 | Acharya et al. | 62/63 |
| 4,887,539 | A * | 12/1989 | Magaldi | 110/165 R |
| 5,651,191 | A * | 7/1997 | Walunas et al. | 34/236 |
| 5,717,192 | A * | 2/1998 | Dobie et al. | 219/681 |
| 5,964,044 | A * | 10/1999 | Lauersdorf et al. | 34/224 |
| 5,968,578 | A * | 10/1999 | Knisely | 426/524 |
| 6,202,573 | B1 * | 3/2001 | Bachik | 110/165 A |
| 6,230,633 | B1 * | 5/2001 | Magaldi et al. | 110/189 |
| 6,259,064 | B1 * | 7/2001 | Wilson | 219/400 |
| 6,357,140 | B1 * | 3/2002 | Heyer et al. | 34/236 |
| 6,689,180 | B1 * | 2/2004 | Liao | 53/557 |
| 6,745,705 | B1 * | 6/2004 | Benesch et al. | 110/165 A |
| 2010/0206203 | A1 * | 8/2010 | Magaldi | 110/348 |

FOREIGN PATENT DOCUMENTS

| | | | | |
|---|---|---|---|---|
| EP | 2 182 280 | A1 | 5/2010 | |
| IT | EP 0252967 | A1 * | 1/1987 | 110/165 R |
| IT | EP 0931981 | A2 * | 7/1999 | |

* cited by examiner

CONVEYING MEANS AND METHOD FOR CONVEYING HOT MATERIAL

FOREIGN PRIORITY CLAIM

This Patent Application claims priority to German Patent Application No. 10 2010 024 020.6 filed on Jun. 16, 2010, entitled, "CONVEYING MEANS AND METHOD FOR CONVEYING HOT MATERIAL", the contents and teachings of which are hereby incorporated by reference in their entirety.

FIELD OF THE INVENTION

The present invention relates to a conveying means (or assembly) and to a method for conveying hot material. The invention is used in particular in combustion plants having at least one combustion boiler, for example plants for burning fossil fuels or waste combustion plants.

BACKGROUND

When ash, slag and combustion residues, also referred to below as "hot material", are transported away, it is of particular importance, firstly, to solidify or cure the hot materials, which are still partially in melt form, in a specific manner by cooling such that, in particular, the materials can be conveyed or further processed after being extracted from the combustion boiler. Furthermore, it is also desirable to use the energy still found in the hot material and therefore to improve the overall efficiency of the combustion plant or of the combustion boiler.

It was initially assumed that quenching in a water bath was necessary for conveying the hot materials ("wet discharging"). However, this required large quantities of water which were not readily available in particular in dry regions. In addition, the water used had to be expensively cleaned. Therefore, a transition has been made since the 1990s to "dry extraction systems". In this case, the hot material is placed onto conveyor belts where it is transported further, with specific cooling of the hot material being carried out on the conveyor belt. The conveyor belts are generally designed so as to be encapsulated in relation to the outer environment, i.e. have a housing which prevents combustion gases which are still being produced during the treatment of the material from being able easily to escape into the environment. In addition, the combustion boilers are operated at a negative pressure such that a gas flow enters the housing through a gas inlet or a material outlet of the housing, where it is extracted by corresponding suction counter to a conveying direction of the hot material towards the combustion boiler, with the hot material being cooled in the process by the gas flow.

SUMMARY

In order to sufficiently cool the material, relatively long conveying sections of the material are required in comparison to wet discharging. In particular, conveyor belts or extraction devices arranged consecutively are frequently proposed, wherein ash comminutors and/or intermediate bunkers are arranged therebetween to further improve the cooling. However, it has to be taken into consideration in these constructions that a considerable amount of construction space regularly has to be available for this purpose. In addition, there is the desire to further increase the overall efficiency of combustion plants by improved recovery of energy from the hot material.

Taking this as the starting point, it is the object of the present invention to at least partially solve the problems described with respect to the prior art.

In particular, it is also an object of the invention to provide a conveying means for hot material, with which sufficient cooling and optimum recovering of energy from the hot material can be achieved even over comparatively short conveying sections. Furthermore, a method for conveying hot material is also to be provided, with which sufficient cooling and optimum recovery of energy from the hot material can be realized even over comparatively short conveying sections.

Certain objects are achieved by a conveying means for hot material, having at least one conveyor belt and at least one housing at least partially surrounding the at least one conveyor belt. At least one deflecting means (or deflector) for deflecting a gas flow flowing longitudinally with respect to the at least one conveyor belt towards the at least one conveyor belt is arranged in or on the housing. The gas flow can be deflected by the at least one deflecting means over at least 25% of a conveying section of the at least one conveyor belt.

Additionally, certain objects are achieved by a method for conveying hot material with a conveying means. The method includes at least the following steps:

a) conveying hot material on at least one conveyor belt having one conveying direction over a conveying section,
b) setting up a gas flow flowing longitudinally with respect to the at least one conveyor belt counter to the conveying direction, and
c) deflecting a gas flow towards the at least one conveyor belt over at least 25% of the conveying section.

Further advantageous embodiments of the invention are specified herein. It should be pointed out that the features cited individually can be combined with one another in any technologically expedient manner and define further embodiments of the invention. Furthermore, the features specified herein are stated precisely and explained in more detail in the description, in which further preferred embodiments of the invention are presented.

The conveying means according to the invention for hot material has at least one conveyor belt and at least one housing at least partially surrounding the at least one conveyor belt, wherein at least one deflecting means for deflecting a gas flow flowing longitudinally with respect to the at least one conveyor belt towards the at least one conveyor belt is arranged in or on the housing, and wherein the gas flow can be deflected by the at least one deflecting means over at least 25% of a conveying section of the at least one conveyor belt.

The conveying means involves in particular "plate conveyors" and/or "drag conveyors" which can have metal plates for receiving materials to be conveyed, and metal chains and/or metal knits and/or metal meshes for transmitting driving forces. The conveyor belt is at least partially surrounded by a housing, in particular so as essentially to form an encapsulation of the conveyor belt, thus avoiding the undesirable escape of ash and/or gases into the environment. In particular, the housing is designed to be substantially gastight with respect to the environment, with the exception of at least one predetermined gas inlet (in particular at least one air inlet opening) and the (at least one) material inlet, through which hot material can be fed onto the conveyor belt, and the material outlet through which material from the conveyor belt can be let out of the housing. In other words, this also means that the housing preferably surrounds the entire conveyor belt, and permits gas exchange (only) via the abovementioned openings. The housing is preferably composed of metal.

For the (dry) cooling of the hot material during transportation or storage on the conveyor belt, the apparatus (in particular the housing) is configured in such a manner that a gas flow flowing longitudinally with respect to the at least one conveyor belt is formed. The gas flow flowing longitudinally with respect to the at least one conveyor belt is produced in particular by a (cool) gas being sucked, in particular from the environment, for example air, into the housing through at least one material outlet and/or at least one gas inlet by a negative pressure source, for example a combustion boiler connected directly or indirectly to the housing, and flowing within the housing in the direction of the negative pressure source longitudinally with respect to the at least one conveyor belt or in a counterflow longitudinally with respect to the conveying direction of the hot material. Of course, it is also possible (as an alternative or in addition) for use also to be made of an active entry of gas into the housing by means of a positive pressure source such that the gas is blown into the gas inlet. Upon flow through the housing, the gas flow cools the hot material conveyed on the conveyor belt, the material involving in particular slag, ash and/or combustion residues.

In order to intensify the cooling of the hot material by the gas flow and in particular in order to avoid gas flow boundary layers of lower flow velocity and/or low flow exchange in the region of the conveyed, hot material, at least one deflecting means for deflecting the gas flow flowing longitudinally with respect to the at least one conveyor belt is arranged in or on the housing.

To this end, the deflecting means is designed to deflect the gas flow (otherwise) flowing longitudinally with respect to or parallel to the conveying direction of the at least one conveyor belt at least by 30°, preferably at least by 60° or particularly preferably at least by 90° in the direction of the conveyor belt. The at least one deflecting means is arranged above the at least one conveyor belt, wherein a distance perpendicular to the conveyor belt is formed between the at least one deflecting means and the at least one conveyor belt. The distance corresponds to at least one loading height, which is generally to be anticipated, of the at least one conveyor belt or is preferably even greater than the loading height which is generally to be anticipated. The loading height involves the maximum height of the hot material which is generally to be anticipated perpendicularly to the at least one conveyor belt on the at least one conveyor belt. The deflecting means can extend completely and/or partially over a width (transversely with respect to the conveying direction) of the at least one conveyor belt.

In order to obtain a significant improvement in the cooling of the hot material, it is furthermore important for the gas flow to be able to be deflected by the at least one deflecting means over at least 25%, preferably at least 50% and particularly preferably even 100% of a conveying section of the at least one conveyor belt. This means in particular that the gas flow is deflected in this region and impinges on the hot material or on the conveyor belt. In this case, the conveying section of the at least one conveyor belt extends from a feed region, in which the hot material is fed onto the conveyor belt, as far as a dispensing region, in which the hot material is dispensed from the conveyor belt. In principle, it is accordingly possible for an individual deflecting means to extend completely over the entire conveying section region mentioned above, but it is also possible for the deflecting means to be segmented or for a plurality of deflecting means to be provided which each form a partial region and then also act in total at least on the entire conveying section region mentioned above. The deflecting means may be an integral (one-piece) part of the housing, i.e., for example, may be cast at the same time therewith, but it is also possible for the deflecting means to be a fitted component which is positioned on the housing. In addition, the at least one deflecting means can be configured in such a manner that the operative region of the deflecting means has a constant and/or different effect along the conveying section on the gas flow, for example with reference to the proportion of deflected (and/or mixed) gas flow.

The at least one deflecting means is preferably constructed to deflect the gas flow flowing longitudinally with respect to the at least one conveyor belt transversely with respect to the at least one conveyor belt. By this means, the gas flow impacts preferably substantially perpendicularly on the hot material or on the conveyor belt such that the hot material is particularly intensively cooled.

It is likewise advantageous if the at least one deflecting means is arranged in a fixed position in the housing along a conveying direction of the conveyor belt. This means in particular that the at least one deflecting means is not arranged directly on and/or at the conveyor belt and does not move together therewith. Furthermore, "positionally fixed" also means that a defined position of the deflecting means relative to the housing, to the conveyor belt, to the material inlet, to the material outlet and/or to the gas inlet is ensured, for example via predetermined fastening points and/or bearing points (directly or indirectly) towards the housing. A predetermined (homogeneous or inhomogeneous) flow profile can therefore be set over the conveying section and maintained during operation.

In a development of the invention, it is proposed that the conveying means has at least one sensor for ascertaining a loading height of the at least one conveyor belt with hot material transversely with respect to the conveyor belt. The sensor may be, for example, a light barrier and/or a mechanical pivoting arm. It can be ascertained by the sensor whether the distance between the at least one deflecting means and the at least one conveyor belt is at least the same size as the loading height of the at least one conveyor belt with hot material. This makes it possible to ensure that the at least one deflecting means does not block the conveying of the hot material on the conveyor belt, and/or that the at least one deflecting means does not come into contact with the hot material.

The at least one deflecting means preferably includes at least one deflecting means from the following group:

at least one perforated plate, at least one directional baffle, at least one ventilator.

The at least one perforated plate preferably involves at least one metal plate which has holes, for example in the form of bores, and/or slots and/or similar apertures. Depending on the desired deflection of the gas flow, the holes and/or slots and/or apertures can be introduced into the perforated plate at an angle or perpendicularly to the surface. It is optionally also possible to use a porous plate as the performed plate. In particular, a plurality of perforated plates can be fitted in and/or on the housing in the conveying direction of the at least one conveyor belt and/or transversely with respect to the conveying direction of the at least one conveyor belt. In addition, the at least one perforated plate is arranged in and/or on the housing preferably parallel to the at least one conveyor belt. In this case, the gas flow is deflected by the holes and/or slots and/or apertures (for example also pores) in the at least one perforated plate. In order to further reinforce the deflection and/or to deflect a larger proportion of the gas flow, the upper side of the at least one perforated plate can have additional flow-resetting means (or sections) which protrude from the upper side of the at least one perforated plate and conduct some of the gas flow in the direction of the holes and/or slots and/or apertures in the at least one perforated plate. Furthermore, at least some of the holes and/or slots and/or apertures can have a flow accelerator, for example a nozzle or the like, in the region of a lower side of the at least one perforated plate, the flow accelerators accelerating the gas flow passing therethrough and/or distributing the gas flow over a greater area.

The at least one directional baffle is preferable designed in the manner of a metal baffle, wherein the latter can extend entirely or partially over a width (transversely with respect to the conveying direction) of the conveyor belt and/or of the housing. In order to ensure a deflection of the gas flow over at least 25% of a conveying section of the at least one conveyor belt, it is furthermore proposed to arrange a plurality of directional baffles along the conveying direction of the at least one conveyor belt, for example at least three directional baffles per meter, preferably at least six directional baffles per meter or particularly preferably at least 9 directional baffles per meter. It is likewise proposed to arrange a plurality of directional baffles in and/or on the housing transversely with respect to the conveying direction. In this case, the directional baffles can be arranged spaced apart from one another at regular and/or different intervals and/or so as to be offset transversely with respect to the conveying direction, and/or have different lengths transversely with respect to the conveying direction and/or have different lengths longitudinally with respect to the conveying direction. In particular, the at least one directional baffle is arranged pivotably in/on the housing such that the gas flow can be deflected at different angles.

The at least one ventilator is in particular a driven impeller which is positioned on the housing and with which at least part of the gas flow can be deflected in the direction of the at least one conveyor belt. The at least one ventilator extends entirely or partially over the width (transversely with respect to the conveying direction) of the conveyor belt and/or of the housing. In order to ensure deflection of the gas flow over a large region of the conveying section of the at least one conveyor belt, it is furthermore proposed to arrange a plurality of ventilators along the conveying direction of the at least one conveyor belt, for example at least one ventilator per 3 meters, preferably at least one ventilator per 1 meter. It is likewise proposed to arrange a plurality of ventilators in and/or on the housing transversely with respect to the conveying direction. In this case, the ventilators can be spaced apart from one another at regular and/or different intervals and/or can be arranged so as to be offset transversely with respect to the conveying direction and/or can have different diameters, power, etc. In particular, the at least one ventilator is arranged pivotably in/or on the housing such that the gas flow can be deflected at different angles.

The abovementioned deflecting means can be combined in respect of type, number, arrangement and/or configuration (distances, angles, length) so as to achieve a predetermined flow profile of the (otherwise) longitudinally flowing gas flow through the housing. In particular, the effect which can also be achieved by this is that the entering gas flow is conducted in a specific manner to a predetermined contact region towards the conveyor belt, for example by (only) part of the gas flow towards the conveyor belt being deflected counter to the conveying direction while another part is guided along the housing at a distance from the conveyor belt (in particular optionally with thermal protection). It is also possible for different zones of the conveying section to be treated or cooled at a differing intensity (for example by means of different proportions of the gas flow) in a specific manner by means of a correspondingly adapted deflection.

Furthermore, a combustion plant is also proposed which has at least one conveying means according to the invention and at least one housing adjoining the combustion plant, wherein the at least one housing includes at least one gas inlet at a material outlet and at least one gas outlet at a material inlet. It is preferred for the combustion plant to have a combustion boiler which operates at a (low) negative pressure such that the gas flow entering the housing via the gas inlet finally flows via the material inlet into the combustion boiler, and therefore the material inlet at the same time forms the gas outlet. However, it may optionally also be expedient to provide the gas outlet separately in the vicinity (for example at a maximum distance of 3 meters, in particular even only a maximum of 1 meter) of the housing in order to supply the (heated) gas flow to a filter and/or to another region of the combustion plant (for example to the flue duct). The gas inlet may likewise be formed as a separate opening of the housing, as a valve and/or via the material outlet. It is preferred for the gas flow which flows in and/or is discharged to be controlled, in particular with the combustion processes of the combustion plant being taken into consideration.

Following a further aspect of the invention, a method for conveying hot material with a conveying means is also proposed, the method including at least the following steps:

a) conveying hot material on at least one conveyor belt having one conveying direction over a conveying section,
b) setting up a gas flow flowing longitudinally with respect to the at least one conveyor belt counter to the conveying direction,
c) deflecting a gas flow towards the at least one conveyor belt over at least 25% of a conveying section.

The method can be implemented in particular by the apparatus according to the invention which is described here. In order to avoid repetitions, reference is therefore also made to the above explanations regarding the design, the operation and/or modifications of the invention. The explanations below regarding the characterization of the apparatus can also be used.

A particularly directed and/or concentrated intense cooling of the hot material on the conveyor belt can be obtained by deflecting the gas flow towards the at least one conveyor belt over at least 25%, preferably at least 50%, particularly preferably even 100% of the conveying section of the at least one conveyor belt, and a particularly high proportion of the thermal energy present in the hot material can be recycled to a combustion plant.

It is particularly advantageous if at least part of the gas flow flows counter to the hot material and, in step c), is deflected transversely with respect to the at least one conveyor belt. "Counterflow" is intended to express the fact that the conveying direction of the material and the direction of the flow of the gas are (at least partially) oriented in opposite directions. By this means, particularly vigorous cooling of the hot material on the conveyor belt is obtained.

It is furthermore advantageous if a distance between the at least one deflecting means and the at least one conveyor belt is changed depending on a loading height of the at least conveyor belt with hot material. In particular, it is proposed here that the distance between the at least one deflecting means and the at least one conveyor belt is increased if the distance between the at least one deflecting means and the at least one conveyor belt is less than or equal to a loading height of the at least one conveyor belt with hot material. The distance between the at least one deflecting means and the at least one conveyor belt can be increased in particular by the at least one deflecting means being moved away from the conveyor belt and/or being pivoted away from the conveyor belt.

It is particularly advantageous if the gas flow is thoroughly mixed above the at least one conveyor belt by the at least one deflecting means. This in particular causes swirling of the gas flow within the housing, such that there is improved cooling of the hot material by avoiding hydrodynamic boundary layers in the region of the hot material, and/or comparatively cooler parts of the gas flow from regions at a greater distance from the at least one conveyor belt can be brought into contact with the hot material. In addition, it is thus optionally possible to thoroughly mix gas flow parts of differing temperatures.

Furthermore, it is advantageous if at least one first deflecting means deflects at least some of a gas flow flowing in the vicinity of a housing of the conveyor belt towards at least one second deflecting means, wherein the at least one second deflecting means at least distributes or accelerates the deflected gas flow towards the at least one conveyor belt.

The first deflecting means may be in particular a flow-resetting means of a perforated plate which deflects at least some of a gas flow flowing in the vicinity of a housing of the conveyor belt in the direction of a second deflecting means. The second deflecting means, which is then preferably at least partially arranged between the first deflecting means and the conveyor belt, can then distribute the supplied gas flow to the material or to the conveyor belt in a specific manner. For this purpose, the second deflecting means can extend over a larger region of the conveying section than the first deflecting means, thus making it possible to provide, for example, a plate through which the flow can pass. It is also advantageous if an (individual) second deflecting means passes on the partial gas flows deflected by a plurality of first deflecting means and optionally even cools the gas flows (in particular by means of a cooling medium or a heat sink with which contact is made).

BRIEF DESCRIPTION OF THE DRAWINGS

The invention and the technical environment are explained in more detail below with reference to the figures. It should be pointed out that the figures show particularly preferred variant embodiments of the invention but the latter is not restricted thereto. In the figures, identical elements are provided with the same reference numbers. In the figures, schematically.

DETAILED DESCRIPTION

Figure 1:
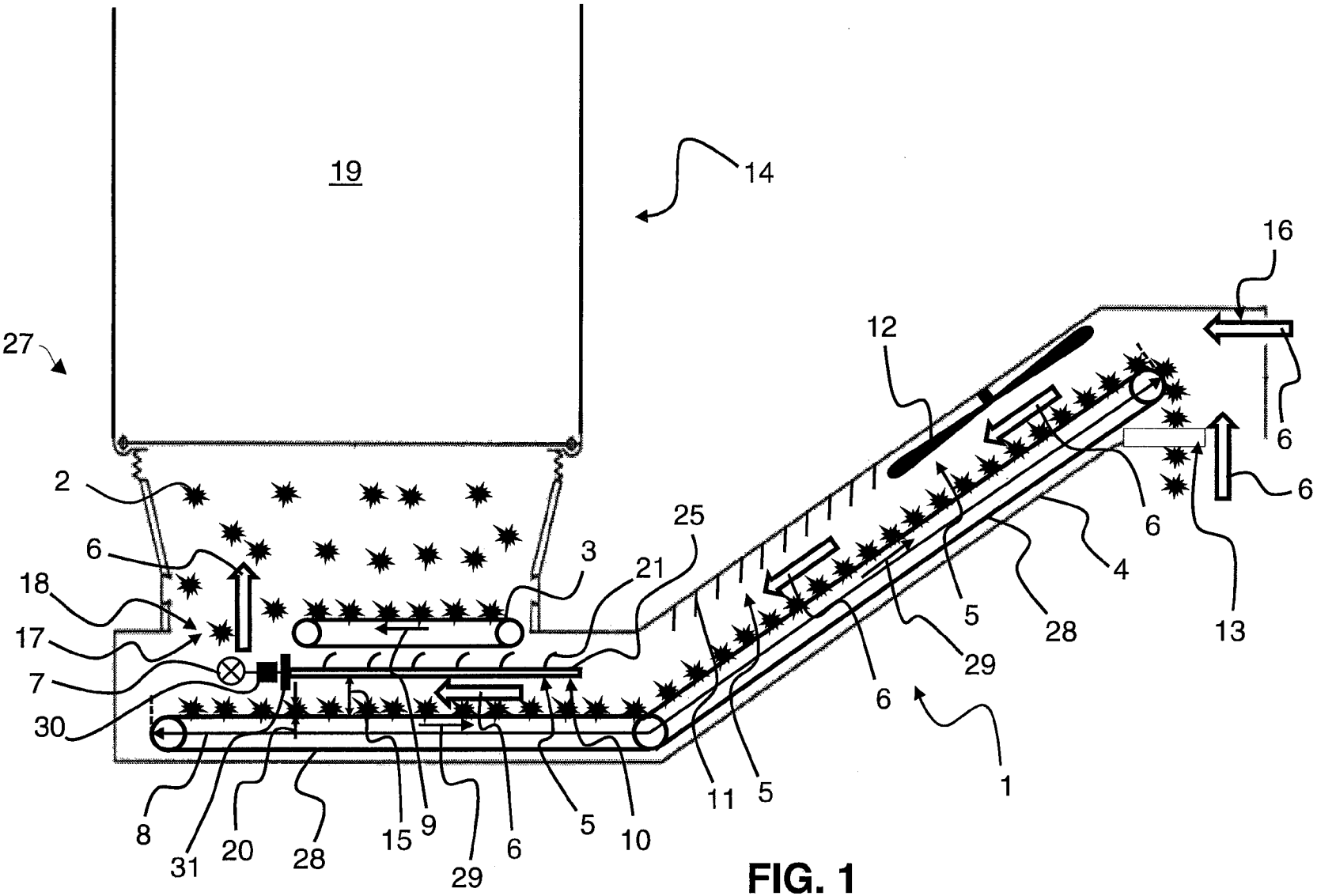
FIG. 1: shows a conveying means according to the invention for hot material.

FIG. 1 shows a conveying means (or assembly) 1 for hot material 2, which is connected indirectly to a combustion boiler 19 of a combustion plant 14 via a shaft 27 (optionally also designed as an at least partially closable funnel shaft). The conveying means 1 has a first conveyor belt 3 and a second conveyor belt 28 which are both at least partially surrounded by a housing 4. Some of the hot material 2 from the combustion boiler 19 first of all drops onto the first conveyor belt 3 and is then transported by the latter in a first conveying direction 9. The hot material 2 subsequently drops in the region of a material inlet 18 onto the second conveyor belt 28 and is transported by the second conveyor belt 28 in the direction of a second conveying direction 29 to a material outlet 13 of the housing 4. Merely for the sake of completeness, it should be expressly pointed out that the apparatus can also be designed with a single conveyor belt in the housing 4.

Owing to a negative pressure prevailing in the combustion boiler 19, a gas flow 6 (here an airflow—illustrated in the form of arrows) is sucked out of the environment into the housing 4 through a gas inlet 16 and the material outlet 13 and flows in the housing 4 longitudinally with respect to the second conveyor belt 28 to the gas outlet 17 of the housing 4 and subsequently into the combustion boiler 19. In this case, the gas flow 6 cools the hot material 2 which is transported along the conveying section 8 by the second conveyor belt 28. The conveying section 8 extends from the material inlet 18 as far as the material outlet 13. The gas flow therefore flows counter to the hot material, and therefore the gas flow absorbs heat and material constituents which may not yet have been combusted and is finally recycled to the combustion boiler. The effectiveness of the combustion boiler can therefore also be improved.

In order to improve the cooling of the hot material 2, three deflecting means (or deflectors) 5 are formed in the housing 4 above the second conveyor belt 28. In this example embodiment, the left deflecting means 5 is designed as a perforated plate 10, the central deflecting means 5 is designed as a plurality of directional baffles 11 and the right deflecting means 5 is designed as a ventilator 12. By means of these different deflecting means 5, the gas flow 6 flowing longitudinally with respect to the second conveyor belt 28 is deflected towards the second conveyor belt 28 over at least 25% of the conveying section 8 of the second conveyor belt 28.

In order to prevent the deflecting means 5 from blocking the conveying section 8 of the second conveyor belt 28 in the event of large amounts of the hot material 2 and/or from coming into contact directly with the hot material 2, a sensor 7 which measures a loading height 20 of the second conveyor belt 28 is arranged upstream of the left deflecting means 5. The sensor 7 in turn is connected to a controller 30 in a data-conducting manner, wherein the controller 30 is connected to the controller of a motor 31 for changing a distance 15 between the second conveyor belt 28 and the left deflecting means 5. In addition to monitoring and/or adjusting the deflecting means 5, a similar controller 30 can optionally also serve to adjust the gas flow, and it is therefore possible to (automatically) adapt the deflecting means depending on the conveyed quantity of hot material and/or on the quantity and/or the temperature and/or the moisture of the entering gas flow.

Figure 2:
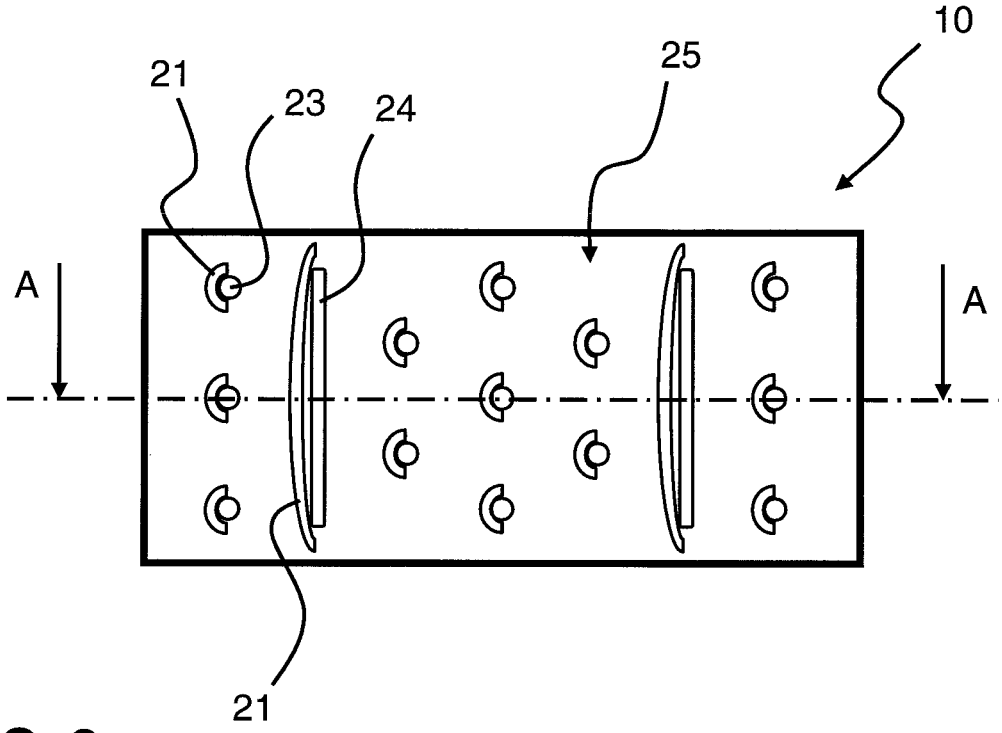
FIG. 2: shows a top view of a perforated plate.

FIG. 2 shows a top view of an upper side 25 of the perforated plate 10. The perforated plate 10 has a plurality of holes 23 and slots 24. Respective flow-resetting means (or flow-resetting sections) 21 are assigned to the holes 23 and slots 24 and can be used to deflect a gas flow (not shown here) in the direction of the holes 23 and slots 24.

Figure 3:
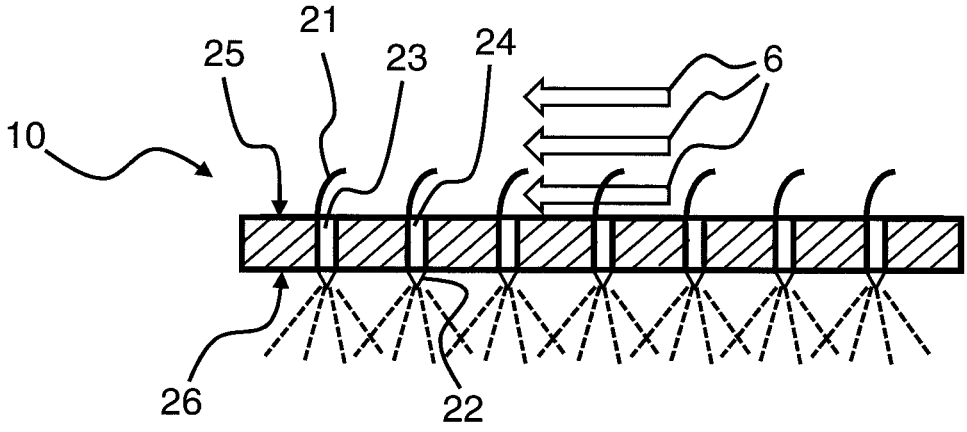
FIG. 3: shows a sectional illustration of the perforated plate.

FIG. 3 shows a section through the perforated plate 10 shown in FIG. 2 along the chain-dotted line A-A. The holes 23 and the slots 24 extend from the upper side 25 of the perforated plate 10 as far as a lower side 26 of the perforated plate 10. In the region of the lower side 26, the holes 23 and slots 24 in the perforated plate 10 have nozzles 22 with which the gas flow 6 can be conveyed in compressed form and/or accelerated in the direction of a conveyor belt 3, 28 (not shown here).

The conveying means according to the invention and the method for conveying hot material are distinguished by particularly effective cooling of the hot material 2 and particularly high recovery of energy from the hot material 2.

LIST OF REFERENCE NUMBERS

1 Conveying means
2 Hot material

3 First conveyor belt
4 Housing
5 Deflecting means
6 Gas flow
7 Sensor
8 Conveying section
9 First conveying direction
10 Perforated plate
11 Directional baffle
12 Ventilator
13 Material outlet
14 Combustion plant
15 Distance
16 Gas inlet
17 Gas outlet
18 Material inlet
19 Combustion boiler
20 Loading height
21 Flow-resetting means
22 Nozzle
23 Holes
24 Slots
25 Upper side
26 Lower side
27 Shaft
28 Second conveyor belt
29 Second conveying direction
30 Controller
31 Motor

What is claimed is:

1. Conveying means for hot combustion residues of a combustion boiler, comprising:

at least one conveyor belt, and at least one housing at least partially surrounding the at least one conveyor belt, wherein at least one deflector for deflecting a gas flow flowing longitudinally with respect to the at least one conveyor belt towards the at least one conveyor belt is arranged in or on the housing, the at least one deflector comprises at least one perforated plate, the perforated plate includes holes formed as at least one of bores, slots and apertures, the upper side of the at least one perforated plate includes a set of flow-resetters protruding from an upper side of the at least one perforated plate and conduct at least a portion of the gas flow in the direction of the holes, and wherein the gas flow can be deflected by the at least one deflector over at least 25% of a conveying section of the at least one conveyor belt.

2. Conveying means according to claim 1, wherein the at least one deflector is designed to deflect the gas flow flowing longitudinally with respect to the at least one conveyer belt transversely with respect to the at least one conveyor belt.

3. Conveying means according to claim 1, wherein the at least one deflector is arranged in a fixed position in the housing along a conveying direction of the conveyor belt.

4. Conveying means according to claim 1, further comprising:

at least one sensor for ascertaining a loading height of the at least one conveyor belt with combustion residues transversely with respect to the conveyor belt.

5. Conveying means according to claim 1, wherein the at least one deflector comprises at least one directional baffle.

6. Combustion plant, comprising:

conveying means for hot combustion residues, the conveying means having at least one conveyor belt, and a housing at least partially surrounding the at least one conveyor belt, wherein at least one deflector for deflecting a gas flow flowing longitudinally with respect to the at least one conveyor belt towards the at least one conveyor belt is arranged in or on the housing, the at least one deflector comprises at least one perforated plate, the perforated plate includes holes formed as at least one of bores, slots and apertures, the upper side of the at least one perforated plate includes a set of flow-resetters protruding from an upper side of the at least one perforated plate and conduct at least a portion of the gas flow in the direction of the holes, and wherein the gas flow can be deflected by the at least one deflector over at least 25% of a conveying section of the at least one conveyor belt, the at least one housing adjoining the combustion plant, wherein the at least one housing comprises at least one gas inlet at a material outlet and at least one gas outlet at a material inlet.

7. Conveying means according to claim 1, wherein at least some of the holes have a flow accelerator on a lower side of the at least one perforated plate.

8. Conveying means according to claim 7, wherein the flow accelerator includes a nozzle.

9. Conveying means according to claim 1, wherein the at least one deflector comprises at least one ventilator.

* * * * *